US012215452B2

(12) United States Patent
Tong et al.

(10) Patent No.: US 12,215,452 B2
(45) Date of Patent: Feb. 4, 2025

(54) TUB ASSEMBLY AND WASHING MACHINE

(71) Applicant: WUXI LITTLE SWAN ELECTRIC CO., LTD., Wuxi (CN)

(72) Inventors: Shuai Tong, Wuxi (CN); Honggang Liu, Wuxi (CN); Yulai Miao, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 239 days.

(21) Appl. No.: 17/909,436

(22) PCT Filed: Jun. 4, 2020

(86) PCT No.: PCT/CN2020/094444
§ 371 (c)(1),
(2) Date: Sep. 6, 2022

(87) PCT Pub. No.: WO2021/189663
PCT Pub. Date: Sep. 30, 2021

(65) Prior Publication Data

US 2023/0117116 A1 Apr. 20, 2023

(30) Foreign Application Priority Data

Mar. 27, 2020 (CN) ..... 202010230408.3

(51) Int. Cl.
*D06F 37/26* (2006.01)

(52) U.S. Cl.
CPC ..... *D06F 37/263* (2013.01); *D06F 37/261* (2013.01); *D06F 37/262* (2013.01)

(58) Field of Classification Search
CPC ..... D06F 37/261; D06F 37/262; D06F 37/263
See application file for complete search history.

(56) References Cited

U.S. PATENT DOCUMENTS

2006/0096330 A1* 5/2006 Kim ..... H02K 1/2791 68/3 R
2015/0082837 A1* 3/2015 Malheiros ..... D06F 37/263 29/469
2018/0327957 A1* 11/2018 Kim ..... D06F 37/14

FOREIGN PATENT DOCUMENTS

| | | | |
|---|---|---|---|
| CH | 170052 | A | 6/1934 |
| CN | 1046202 | A | 10/1990 |
| CN | 2462179 | Y | 11/2001 |
| CN | 201559845 | U | 8/2010 |
| CN | 202820768 | U | 3/2013 |

(Continued)

OTHER PUBLICATIONS

Machine translation of DE-10160788-A1 to Bosch. (Year: 2003).*

(Continued)

*Primary Examiner* — Joseph L. Perrin

(57) ABSTRACT

Provided are a tub assembly and a washing machine. The tub assembly includes an outer tub, and a lining tub disposed in the outer tub fixedly connected to the outer tub. An inner wall of the outer tub is protected by means of the lining tub, thereby preventing the problem of bacteria breeding caused by an inner wall face of the outer tub and washing water being in contact for a long time, or the problem of mildew occurring due to the inner wall of the outer tub being in a damp environment for a long time. The washing effect of a washing machine can be effectively improved, thereby preventing health and hygiene problems, etc.

11 Claims, 16 Drawing Sheets

(56) References Cited

FOREIGN PATENT DOCUMENTS

| | | | | | |
|---|---|---|---|---|---|
| CN | 103161050 | A | | 6/2013 | |
| CN | 203403284 | U | | 1/2014 | |
| CN | 204509783 | U | | 7/2015 | |
| CN | 105730932 | A | | 7/2016 | |
| CN | 106696848 | A | | 5/2017 | |
| CN | 106702669 | A | | 5/2017 | |
| CN | 106633372 | A | | 6/2017 | |
| CN | 206502987 | U | | 9/2017 | |
| CN | 109505094 | A | | 3/2019 | |
| CN | 111748971 | A | | 10/2020 | |
| CN | 111748973 | A | | 10/2020 | |
| DE | 10160788 | A1 | * | 6/2003 | ..... D06F 37/26 |
| GB | 1161212 | A | | 8/1969 | |
| JP | H09313780 | A | | 12/1997 | |
| JP | H11198923 | A | | 7/1999 | |
| JP | 2016150171 | A | | 8/2016 | |
| WO | WO-2011161602 | A1 | * | 12/2011 | ..... D06F 37/02 |

OTHER PUBLICATIONS

International Search Report mailed Dec. 28, 2020 of PCT /CN2020/094444.

First OA with Search Report mailed Mar. 1, 2021 of CN Application No. 202010230408.3.

Second OA with Search Report mailed Aug. 18, 2021 of CN Application No. 202010230408.3.

Third OA mailed Jan. 7, 2022 of CN Application No. 202010230408.3.

Grant Notice with Supplementary Search mailed Apr. 8, 2022 of CN Application No. 202010230408.3.

* cited by examiner

A-A

C-C

TUB ASSEMBLY AND WASHING MACHINE

CROSS-REFERENCES TO RELATED APPLICATIONS

The present disclosure is a national phase application of International Application No. PCT/CN2020/094444, filed on Jun. 4, 2020, which claims priority to Chinese Patent Application 202010230408.3, filed on Mar. 27, 2020, the entireties of which are herein incorporated by reference.

FIELD

Embodiments of the present disclosure relate to the field of laundry treatment apparatus, and more particularly, to a tub assembly and a washing machine.

BACKGROUND

At present, an outer tub of a washing machine is generally made of a plastic material. Thus, after long-term use, an inner surface of the outer tub made of the plastic material would bread bacteria, and pollute a sanitary environment in the tub, and cause a secondary pollution to laundry. In addition, it is difficult for ordinary consumers to disassemble and wash the washing machine. Therefore, how to eliminate the pollution at the root is a problem that needs to be solved at present.

SUMMARY

The present disclosure aims at solve at least one of the problems existing in the related art. In this regard, embodiments of the present disclosure provide a tub assembly, which can avoid a secondary pollution.

Embodiments of the present disclosure also provide a washing machine having the tub assembly as described above.

A tub assembly according to embodiments of the present disclosure includes an outer tub, and a lining tub disposed in the outer tub and fixedly connected to the outer tub.

In the tub assembly according to the embodiments of the present disclosure, an inner wall of the outer tub is protected by means of the lining tub, to prevent the problem of bacteria breeding caused by contact between an inner wall surface of the outer tub and washing water for a long time, or the problem of mildew occurring due to the inner wall of the outer tub being in a damp environment for a long time. By providing the lining tub, the washing effect of the washing machine can be effectively improved, to prevent health and hygiene problems.

According to some embodiments of the present disclosure, the tub assembly also includes an adhesive disposed between the outer tub and the lining tub to bond the lining tub on an inner wall of the outer tub.

According to some embodiments of the present disclosure, the outer tub and the lining tub are formed into an integral structure through an injection molding process.

According to some embodiments of the present disclosure, the lining tub has a through opening defined on a bottom thereof, and a rim of the through opening is embedded in a bottom of the outer tub.

According to some embodiments of the present disclosure, at least a part of the lining tub is recessed away from inside of the lining tub to form at least one recess, and the at least one recess has a material feeding port defined thereon.

In some embodiments, the at least one recess includes at least two recesses. At least one recess of the at least two recesses has a recessed depth smaller than a thickness of the lining tub, and/or at least one recess of the at least two recesses has a recessed depth greater than or equal to the thickness of the lining tub.

In some embodiments, the at least one recess includes at least two recesses, and the at least two recesses include a first recess located on a bottom of the lining tub.

In some embodiments, the at least one recess includes at least two recesses, and the at least two recesses include a second recess located on a tub body of the lining tub.

In some examples, the tub assembly has a second material feeding port disposed on the second recess close to a bottom of the outer tub.

According to some embodiments of the present disclosure, at least a part of a rim of the lining tub protrudes towards outside of the lining tub to form a bending portion embedded in a rim of the outer tub.

According to some embodiments of the present disclosure, a tub body and a bottom of the lining tub are integrally formed in such a manner that the lining tub is formed as an integral structure.

According to some embodiments of the present disclosure, a tub body and a bottom of the lining tub are separately formed in such a manner that the lining tub is formed as a separated structure.

A washing machine according to embodiments of the present disclosure includes the tub assembly according to the above embodiments.

Additional embodiments of the present disclosure will be set forth partly from the following description, and in part will be apparent from the following description, or may be learned by practice of the disclosure.

BRIEF DESCRIPTION OF THE DRAWINGS

The embodiments of the present disclosure will become apparent and readily understood from the following description of embodiments in conjunction with the accompanying drawings, in which.

Figure 1:
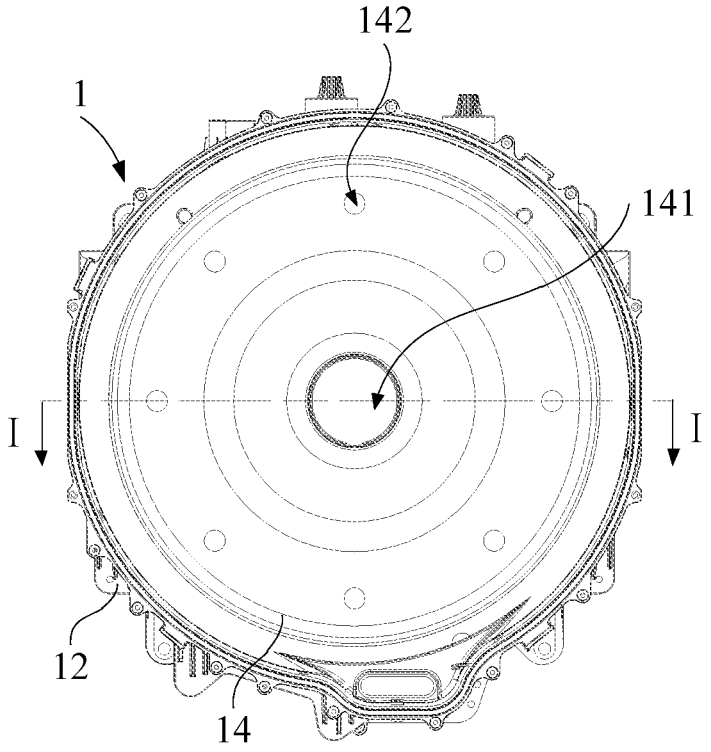
FIG. 1 is a schematic structural view of a tub assembly according to an embodiment of the present disclosure.

REFERENCE SIGNS tub assembly 1, outer tub 12, flanging 121, supporting boss 122, installation port 123 lining tub 14, tub body of the lining tub 1401, first flanging 1402, second through hole 1403, second flanging 1404, third through hole 1405, bottom of the lining tub 1406, third flanging 1407, straight section 14071, inclined section 14072, first through hole 1408, fourth flanging 1409, first notch 14010, through opening 141, first recess 142, first material feeding port 1421, second recess 143, second material feeding port 1431, opening 1432, folded edge 1433, bent portion 144, third recess 145, third material feeding port 1451, convex portion 31, groove 32, concave portion 33.

DETAILED DESCRIPTION OF THE DISCLOSURE

Embodiments of the present disclosure will be described below, examples of which are illustrated in the accompanying drawings, and the same or similar reference signs refer to the same or similar elements or elements having the same or similar functions throughout. The embodiments described below with reference to the accompanying drawings are exemplary, and only used to explain the present disclosure, rather than being construed as a limitation of the present disclosure.

A tub assembly 1 according to embodiments of the present disclosure will be described below with reference to FIGS. 1 to 28.

As shown in FIGS. 1 to 6, the tub assembly 1 according to some embodiments of the present disclosure includes an outer tub 12, and a lining tub 14 disposed in the outer tub 12 and fixedly connected to the outer tub 12.

In the tub assembly 1 according to the embodiments of the present disclosure, an inner wall of the outer tub 12 is protected by the lining tub 14 to avoid an inner wall surface of the outer tub 12 from breeding bacteria due to contact with a washing water for a long time, or to avoid the inner wall of the outer tub 12 from mildewing due to being in a humid environment for a long time to. By arranging the lining tub 14, a washing effect of a washing machine can be effectively improved, to avoid causing health and hygiene problems.

It should be noted that the inner wall surface of the outer tub 12 mentioned in the present disclosure may be understood as a side surface of the outer tub 12 facing towards the lining tub 14, and the side surface includes an inner wall surface of a tub body of the outer tub 12 and an inner wall surface of a bottom of the outer tub 12.

In some embodiments, the lining tub 14 may be made of a stainless steel material that can effectively avoid an adhesion of stains in the washing water. Further, the lining tub 14 has a thickness smaller than that of the outer tub 12, which can reduce production cost of the tub assembly 1. In addition, with this arrangement, it is possible to effectively ensure a connection reliability between the lining tub 14 and the outer tub 12, to prevent the lining tub 14 from affecting service life of the outer tub 12 due to overweight of the lining tub 14.

In some embodiments, the tub assembly 1 also includes an adhesive (not shown) disposed between the outer tub 12 and the inner tub 14 to bond the inner tub 14 onto the inner wall of the outer tub 12.

Here, the adhesive can bond a plastic material with the stainless steel material. The adhesive has properties such as high temperature resistance, low temperature resistance, detergent resistance, water resistance, bacteria resistance, and the like. The adhesive may be a styrofoam or other soft glues. Further, the adhesive may be injected into the bottom of the outer tub 12. After the lining tub 14 is loaded into the outer tub 12, the lining tub 14 is pressed against the outer tub 12 to reliably connect the outer tub 12 and the lining tub 14 by the adhesive. Further, the adhesive may also be disposed on an inner side wall of the outer tub 12.

In other embodiments, the outer tub 12 and the lining tub 14 are integrally formed through an injection molding process.

Figure 2:
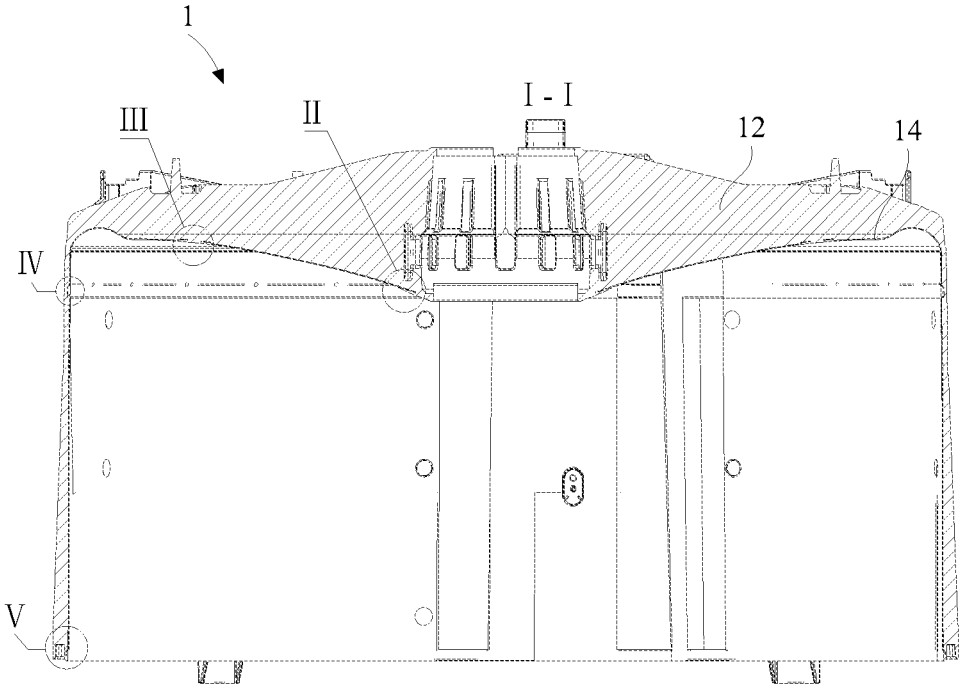
FIG. 2 is a sectional view taking along line I-I section in FIG. 1.
Figure 3:
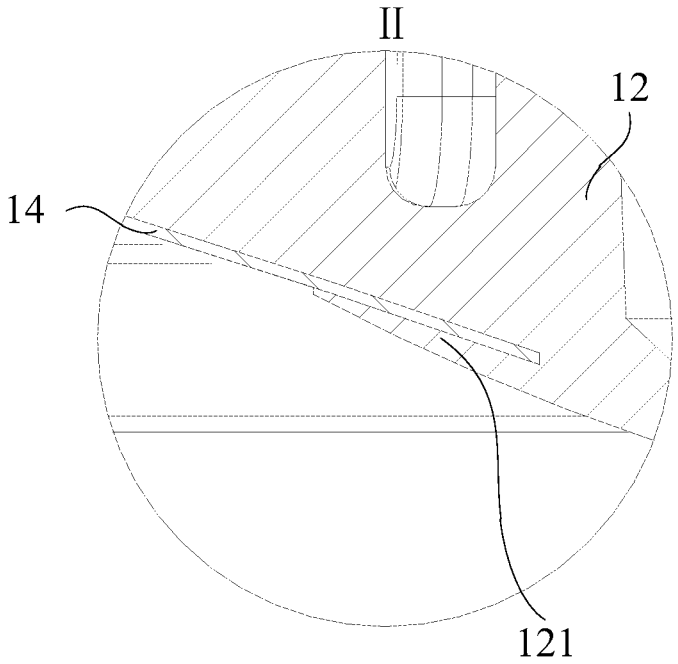
FIG. 3 is an enlarged view of part II shown in FIG. 2.

In further embodiments, as shown in FIG. 1 and FIG. 2, in this embodiment, the outer tub 12 is a plastic outer tub, and the outer tub 12 and the lining tub 14 are integrally formed through the injection molding process, to ensure that the outer tub 12 and the inner tub 14 are reliably connected. Further, a preparation process is simple and easy. In some embodiments, the lining tub 14 is sleeved on a mold, and then the outer tub 12 is formed by injection molding through the plastic material, and a contact area between the outer tub 12 and the lining tub 14 is increased, which in turn effectively enhances a connection strength between the outer tub 12 and the lining tub 14.

Figure 13:
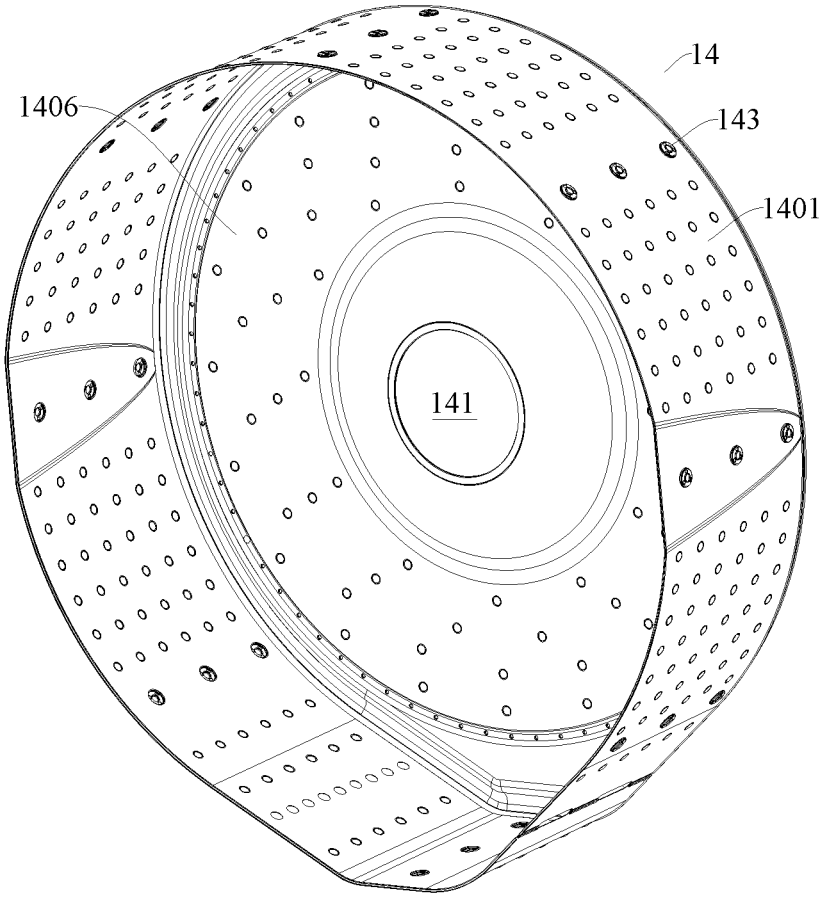
FIG. 13 is a perspective view of a lining tub of a tub assembly according to another example of the present disclosure.

As shown in FIG. 1 and FIG. 13, in some embodiments, the lining tub 14 has a through opening 141 defined on a bottom 1406 thereof, and a rim of the through opening 141 is embedded in the bottom of the outer tub 12.

In some embodiments, the lining tub 14 includes a tub body 1401 and the bottom 1406 that are connected to each other. The through opening 141 is formed on the bottom 1406 of the lining tub 14, and a part of the bottom close to the through opening 141 extends towards a center line of the lining tub 14.

In the injection molding process, an injection mold includes a mould cavity and a mould core. The lining tub 14 is sleeved on the mould core and disposed in the mould cavity. In this case, an accommodation cavity is defined by the part of the bottom of the lining tub 14 extending towards the center line of the lining tub 14 and the mould core. The accommodation cavity is in communication with the through opening 141. When the plastic material for forming the outer tub 12 is injected into the mould cavity under a high pressure, the plastic material can flow into the accommodation cavity through the through opening 141. After cooling and solidification, the plastic material in the accommodation cavity is formed as a flanging 121. That is, in the injection molding process, some of the sizing material forming the outer tub 12 extends towards the inside of the outer tub 12 and is bent away from the center line of the outer tub 12 to form the flanging 121. The flanging 121 is closely connected to an inner bottom surface of the inner tub 14, and the edge of the opening 141 is embedded in the bottom of the outer tub 12. Here, the inner bottom surface of the lining tub 14 refers to a bottom surface on the bottom 1406 of the lining tub 14 facing towards the inside thereof.

In some embodiments, at least a part of the lining tub 14 is recessed away from the inside of the lining tub 14 to form at least one recess. The at least one recess has a material feeding port (not shown) defined thereon.

Figure 4:
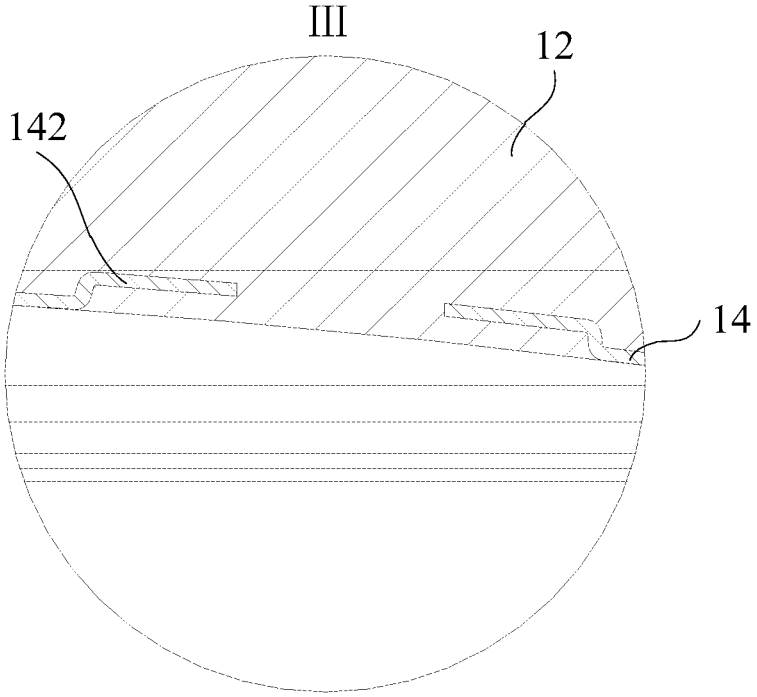
FIG. 4 is an enlarged view of part III shown in FIG. 2.
Figure 5:
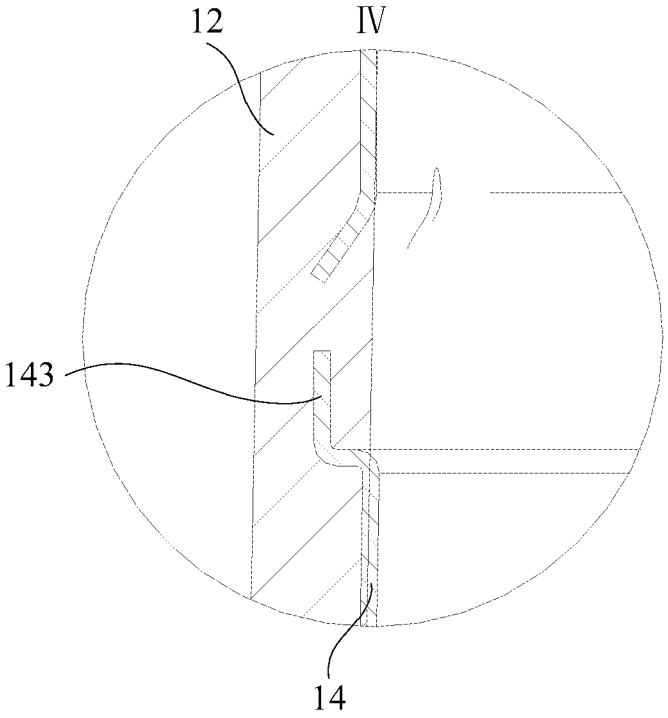
FIG. 5 is an enlarged view of part IV shown in FIG. 2.

As shown in FIGS. 4 and 5, in this embodiment, at least a part of the lining tub 14 is recessed away from the inside of the lining tub 14 to form at least one recess (e.g., a first recess 142, a second recess 143), and the at least one recess has a material feeding port defined thereon. In the injection molding process, the sizing material for forming the outer tub 12 enters the at least one recess through the material feeding port, and the part of the lining tub 14 and the at least one recess are tightly connected to each other further ensure the reliable-connection performance between the outer tub 12 and the lining tub 14.

In some examples, the at least recess may include at least two recesses. At least one recess of the at least two recesses has a recessed depth smaller than a thickness of the lining tub 14, and/or at least one recess of the at least two recesses has a recessed depth greater than or equal to the thickness of the lining tub 14.

In this embodiment, the recess may include two structures. In one of the two structures, the recessed depth of the recess is smaller than the thickness of the lining tub 14, and in this case, the recess has a countersunk hole structure, and the lining tub 14 has a flat outer wall surface. In addition, in the other of the two structures, the recessed depth of the recess is greater than or equal to the thickness of the lining tub 14, and in this case, the recess protrudes towards the outside of the lining tub 14, and the lining tub 14 ha an uneven outer wall surface.

As shown in FIGS. 2, 4 and 5, in some examples, the recess may include at least two recesses including at least one first recess 142 located on the bottom 1406 of the lining tub 14. By arranging the through opening 141 and the at least one first recess 142 on the bottom 1406 of the lining tub 14, the bottom 1406 of the lining tub 14 can be tightly attached to the bottom of the outer tub 12 through the cooperation between the through opening 141 and the at least one first recess 142.

Here, the at least one first recess 142 may include first recesses 142 arranged around the through opening 141 on the bottom 1406 of the lining tub 14 at intervals.

In some examples, the recess may include at least two recesses including a second recess 143 located on a tub body 1401 of the lining tub 14. That is, after the through opening 141 is defined on the bottom 1406 of the lining tub 14, the second recess 143 may be additionally provided on the tub body 1401 of the lining tub 14 to connect all positions of the lining tub 14 and the outer tub 12, and the lining tub 14 is tightly attached to the outer tub 12.

Of course, the through opening 141 and the first recess 142 may be defined on the bottom 1406 of the lining tub 14, and the second recess 143 may be defined on the tub body 1401 of the lining tub 14. Through the cooperation among the through opening 141, the first recess 142 and the second recess 143, an omnidirectional connection between the lining tub 14 and the outer tub 12 can be achieved, to ensure that the lining tub 14 and the outer tub 12 are tightly attached to each other.

In some examples, the tub assembly 1 has a second material feeding port 1431 defined on the second recess 143 close to the bottom of the outer tub 12. In some embodiments, in the injection molding process, some of the sizing material for forming the outer tub 12 flows through the second recess 143 under the action of gravity or other forces, and the sizing material can enter the second recess 143 through the second material feeding port 1431 to avoid the sizing material from being accumulated at the second recess 143 to affect the connection performance between the outer tub 12 and the lining tub 14.

Figure 6:
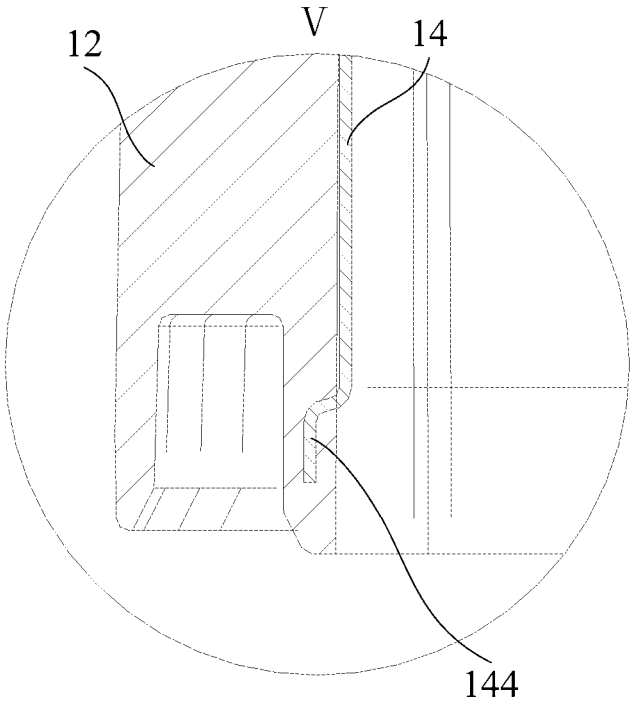
FIG. 6 is an enlarged view of part V shown in FIG. 2.

As shown in FIG. 6, in some embodiments, at least a part of a rim of the lining tub 14 protrudes towards outside of the lining tub 14 to form a bent portion 144 embedded in a rim of the outer tub 12.

In the injection molding process, some of the sizing material flows to the rim of the lining tub 14 and forms the rim of the outer tub 12, and some of the sizing material wraps around the bent portion 144. That is, the bent portion 144 is embedded in the rim of the outer tub 12 to achieve the reliable connection between the outer tub 12 and the lining tub 14.

In some embodiments, the bent portion 144 protrudes by a height smaller than a thickness of the rim of the outer tub 12; and/or, a fourth material feeding port (not shown) is defined on the bent portion 144.

As shown in FIG. 6, in this embodiment, the bent portion 144 protrudes by a height smaller than the thickness of the rim of the outer tub 12. Therefore, the bent portion 144 would not protrude beyond an outer wall surface of the outer tub 12, to ensure an overall appearance of the outer tub 12 and the lining tub 14. Further, the bent portion 144 has the fourth material feeding port defined thereon, and thus some of the sizing material for forming the outer tub 12 flows through the bent portion 144 under the action of gravity or other forces. The sizing material can enter the bent portion 144 through the fourth material feeding port to avoid the sizing material from being accumulated at the bent portion 144 to affect the connection performance between the outer tub 12 and the lining tub 14.

In some embodiments, the tub body 1401 and the bottom 1406 of the lining tub 14 are integrally formed in such a manner that the lining tub 14 is formed as an integral structure, which can reduce the number of components and simplifies the structure of the tub assembly 1.

In other embodiments, the tub body 1401 and the bottom 1406 of the lining tub 14 are separately formed in such a manner that the lining tub 14 is formed as a separated structure, which simplifies the forming process and is beneficial to improve the production efficiency of the tub assembly 1.

Figure 7:
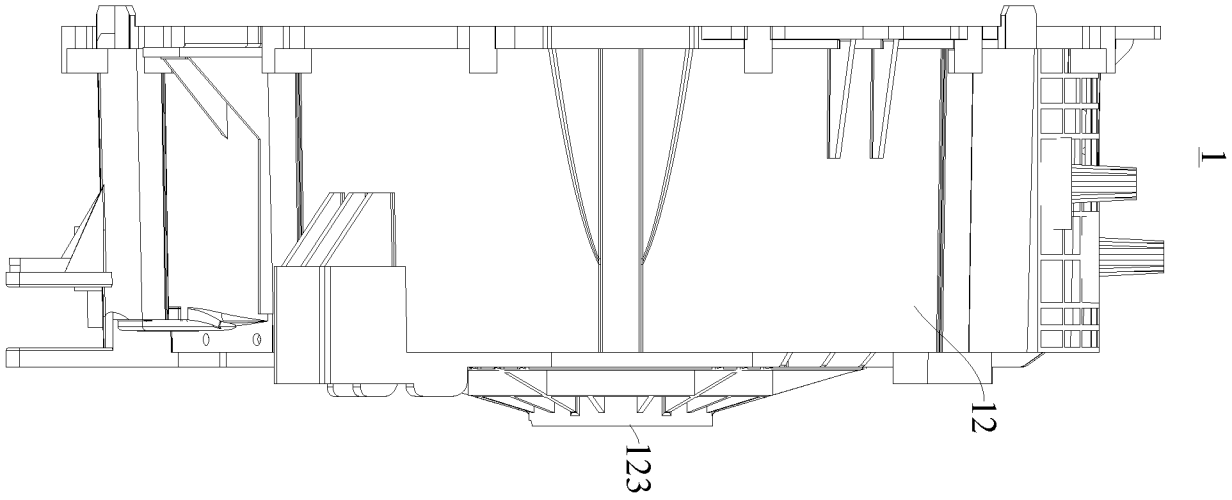
FIG. 7 is a schematic structural view of a tub assembly according to an example of the present disclosure.
Figure 8:
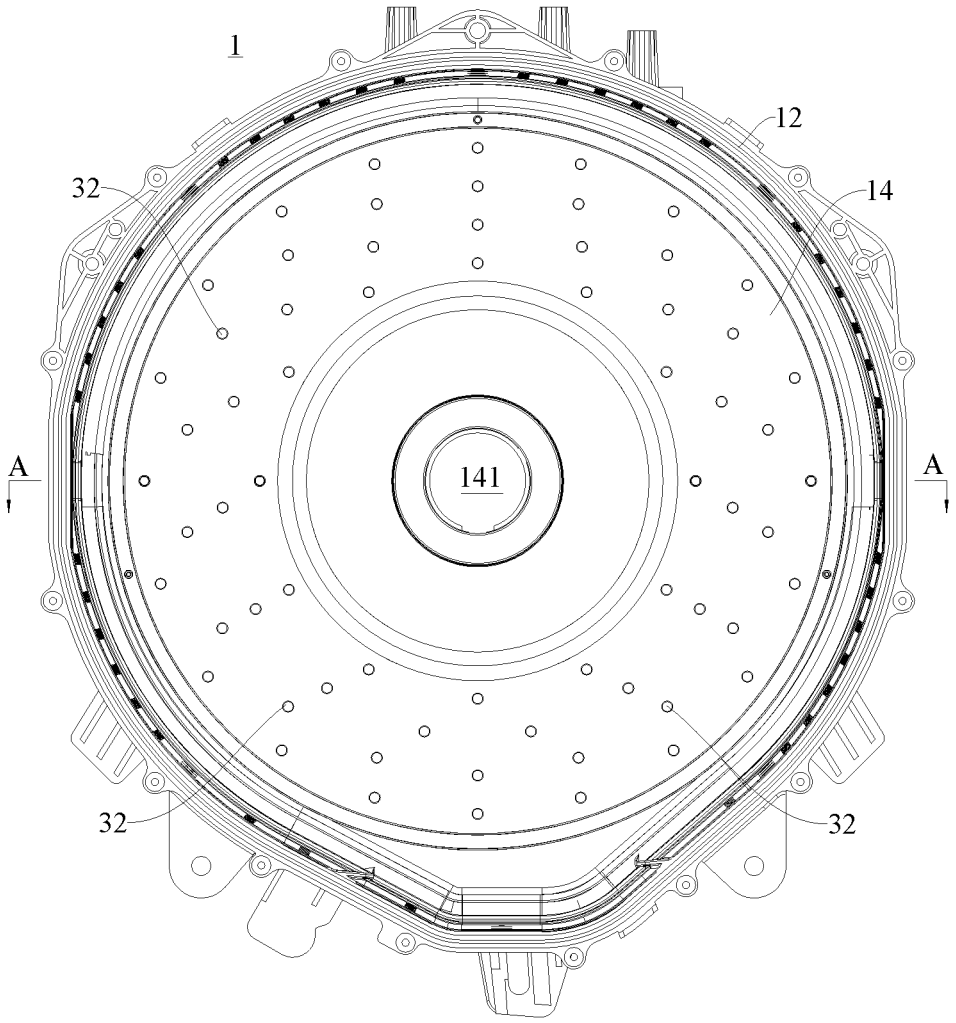
FIG. 8 is a front view of the tub assembly shown in FIG. 7.
Figure 9:
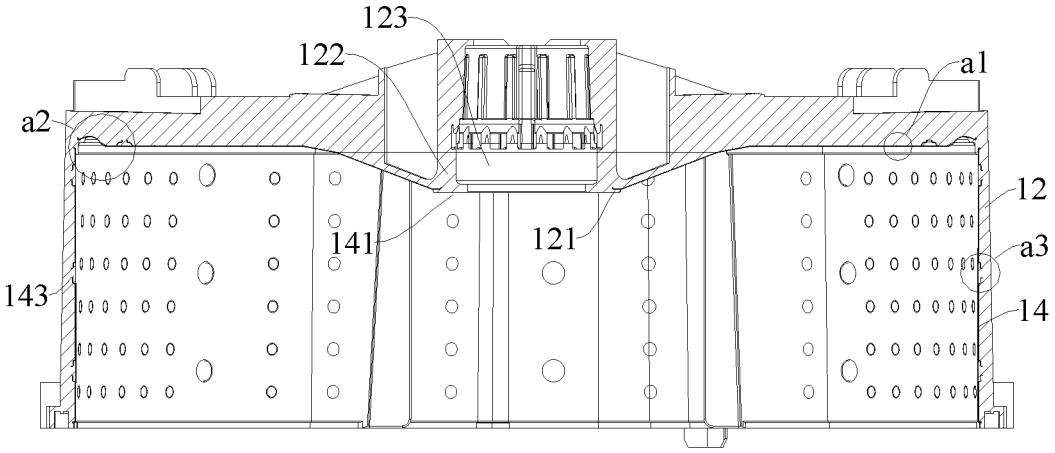
FIG. 9 is a sectional view taking along line A-A in FIG. 8.

As shown in FIGS. 7-9, the tub assembly 1 according to other embodiments of the present disclosure includes an outer tub 12 and a lining tub 14 disposed in the outer tub 12 and fixedly connected to the outer tub 12. Further, at least a part of the lining tub 14 is recessed away from inside of the lining tub 14 to form at least one recess (such as a first recess 142 and a second recess 143 described below).

In the tub assembly 1 according to the embodiments of the present disclosure, by arranging the at least one recess on the lining tub 14, a contact area between the lining tub 14 and the outer tub 12 can be increased to enhance a bonding ability between the lining tub 14 and the outer tub 12, to achieve an anti-separation effect. Further, a structural strength of the lining tub 14 can be ensured, to improve a deformation resistance of the lining tub 14.

As shown in FIG. 9, in some embodiments, the at least recess includes at least one first recess 142 located at a bottom 1406 of the lining tub 14 to increase a contact area between the bottom 1406 of the lining tub 14 and a bottom of the outer tub 12, to improve a bonding ability between the bottom 1406 of the lining tub 14 and the bottom of the outer tub 12. Further, it is possible to improve a deformation resistance of the bottom 1406 of the lining tub 14.

In some examples, the bottom 1406 of the lining tub 14 has a through opening 141 defined thereon, and the at least one first recess includes first recesses 142 arranged around the through opening 141 at intervals.

For example, first recesses 142 is arranged around the through opening 141 in one or more circles manner, and first recesses 142 in each circle is arranged at intervals in a circumferential direction of the through opening 141. First recesses 142 is arranged in an orderly manner to ensure a bonding uniformity of the bottom 1406 of the lining tub 14 with the bottom of the outer tub 12 at different positions, to improve the connection reliability between the lining tub 14 and the outer tub 12.

Figure 11:
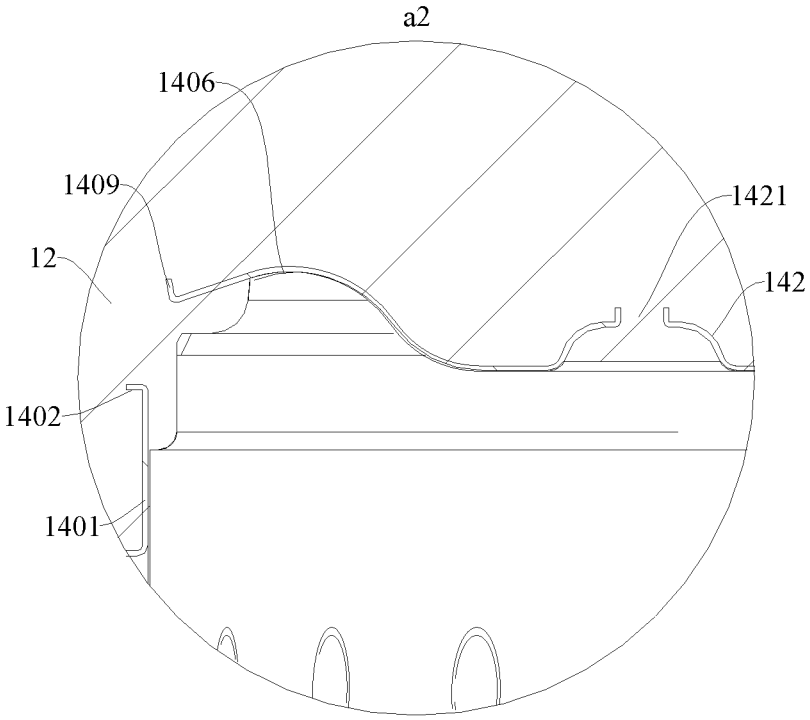
FIG. 11 is an enlarged view of part a2 shown in FIG. 9.

As shown in FIG. 9 and FIG. 11, in some examples, the bottom 1406 of the lining tub 14 has first recesses 142 defined thereon, and some of first recesses 142 have a first material feeding port 1421 defined thereon. In an injection molding process, a sizing material for forming the outer tub 12 enters the first recess 142 through the first material feeding port 1421 to tightly connect a part of the outer tub 12 and the first recess 142, to ensure a connection reliability between the outer tub 12 and the lining tub 14.

Figure 12:
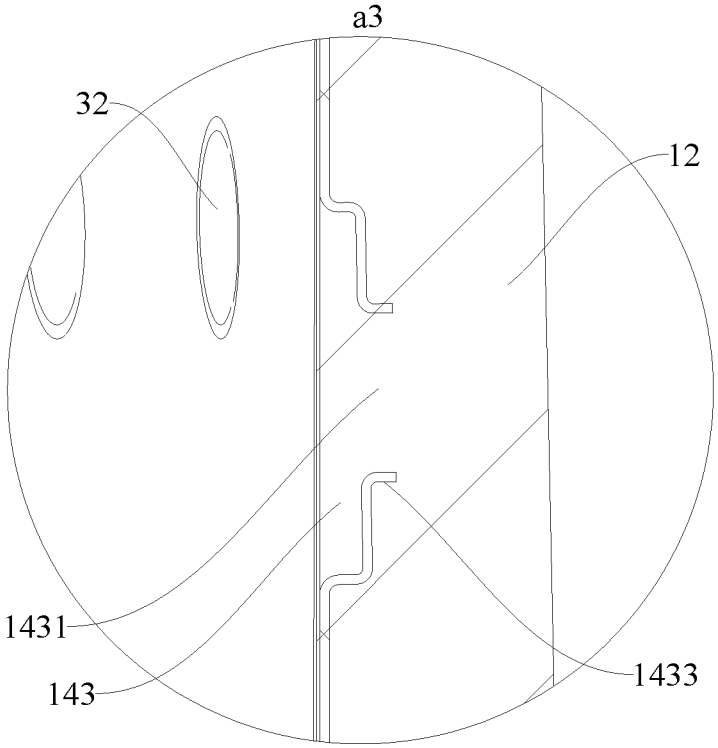
FIG. 12 is an enlarged view of part a3 shown in FIG. 9.

As shown in FIGS. 9 and 12, in some embodiments, the at least one recess includes a second recess 143 located on a tub body 1401 of the lining tub 14 to increase a contact area between the tub body 1401 of the lining tub 14 and a tub body of the outer tub 12, to improve a bonding performance of the tub body 1401 of the lining tub 14 with tub body of the outer tub 12 and a deformation resistance of the tub body 1401 of the lining tub 14.

In some examples, the tub body 1401 of the lining tub 14 has a plurality of second recesses 143, and some of second recesses 143 has a second material feeding port 1431 defined thereon. In the injection molding process, the sizing material for forming the outer tub 12 enters the second recess 143 through the second material feeding port 1431 to tightly connect a part of the outer tub 12 and the second recess 143, to ensure the connection reliability between the outer tub 12 and the lining tub 14.

As shown in FIGS. 13 to 22, in some embodiments, the at least one recess includes a third recess 145 located on the bottom 1406 of the lining tub 14. The bottom 1406 o the lining tub 14 has a through opening 141 defined thereon, and the third recess 145 is formed into an annular recess extending in a circumferential direction of the through opening 141.

Figure 14:
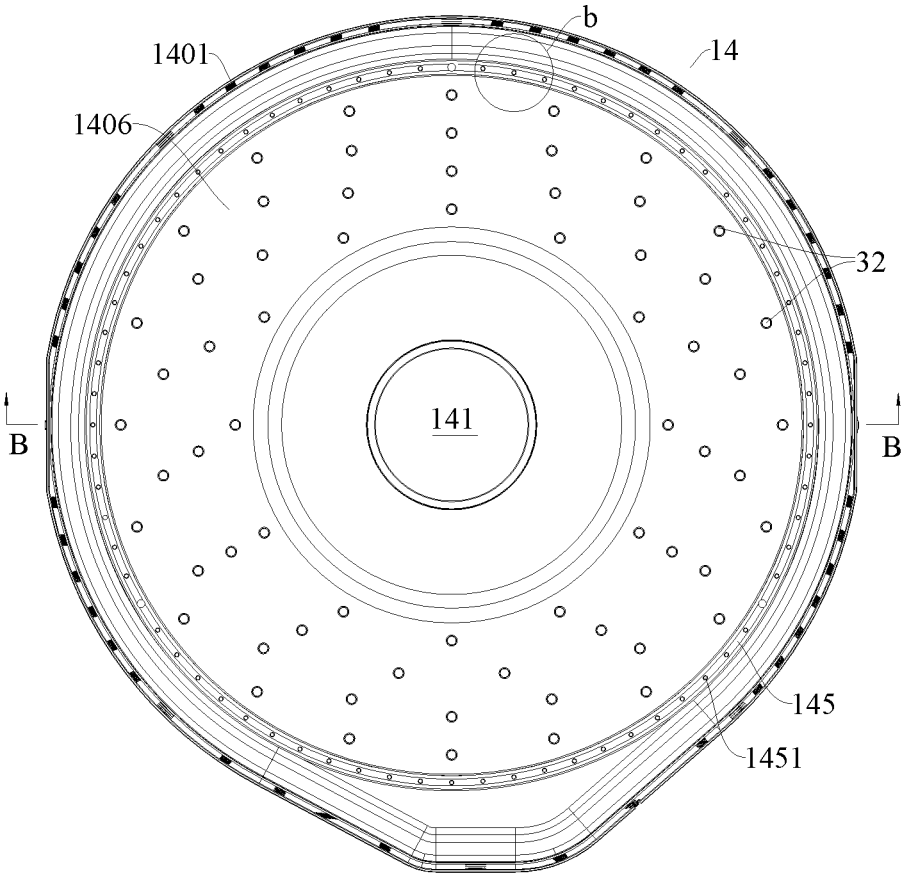
FIG. 14 is a front view of the lining tub of the tub assembly shown in FIG. 13.
Figure 15:
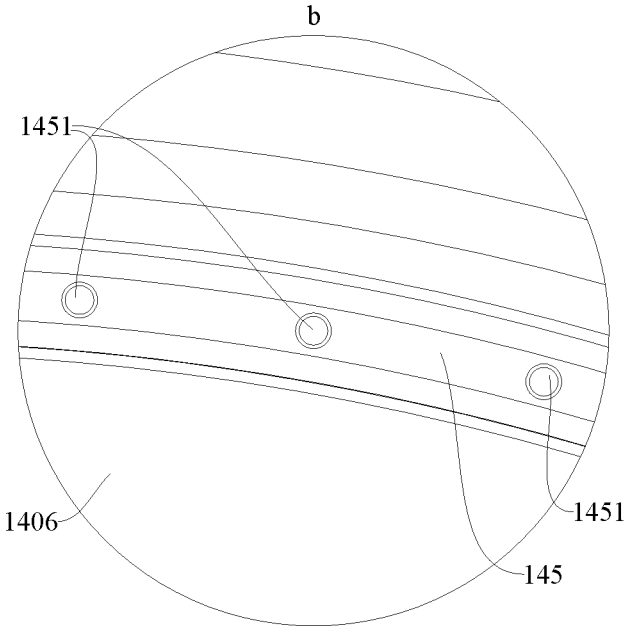
FIG. 15 is an enlarged view of part b shown in FIG. 14.
Figure 16:
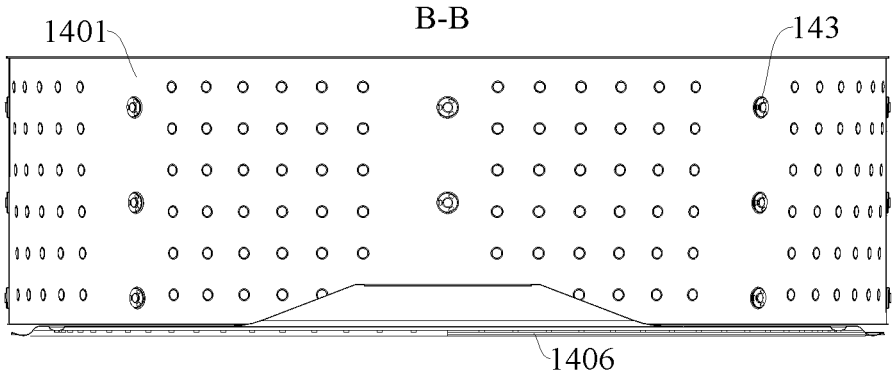
FIG. 16 is a cross-sectional view taking along line B-B in FIG. 14.
Figure 17:
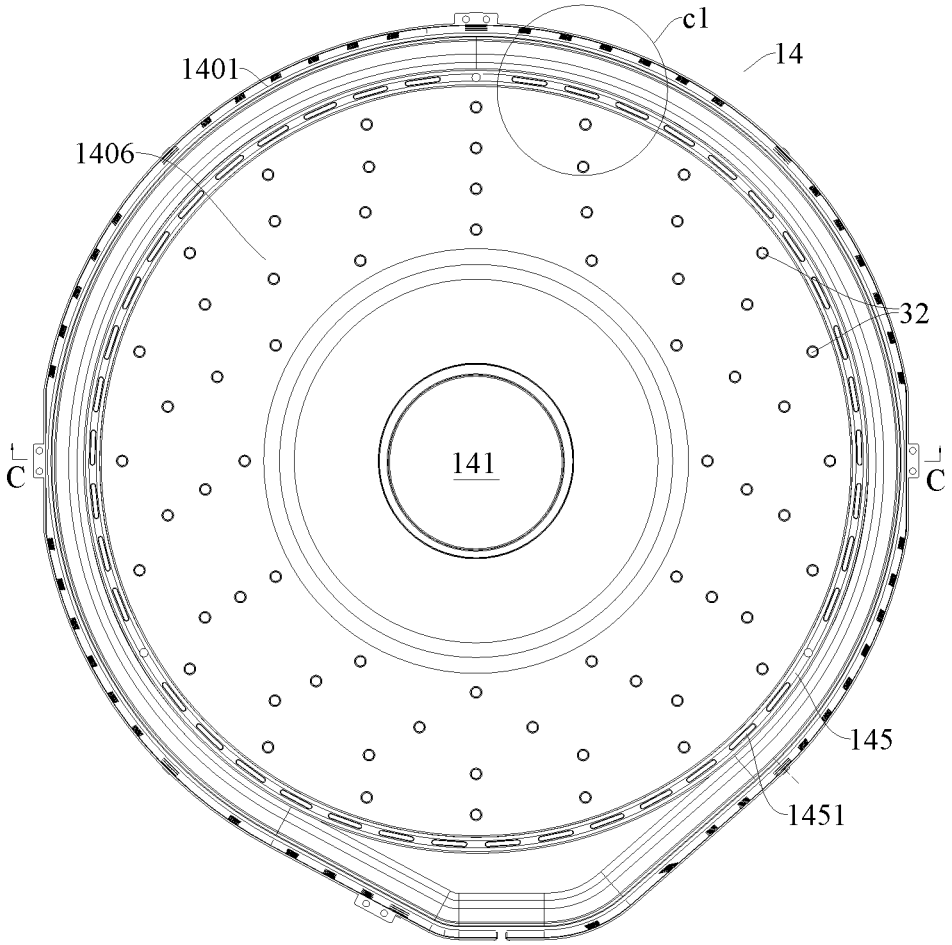
FIG. 17 is a front view of a lining tub of a tub assembly according to another example of the present disclosure.
Figure 18:
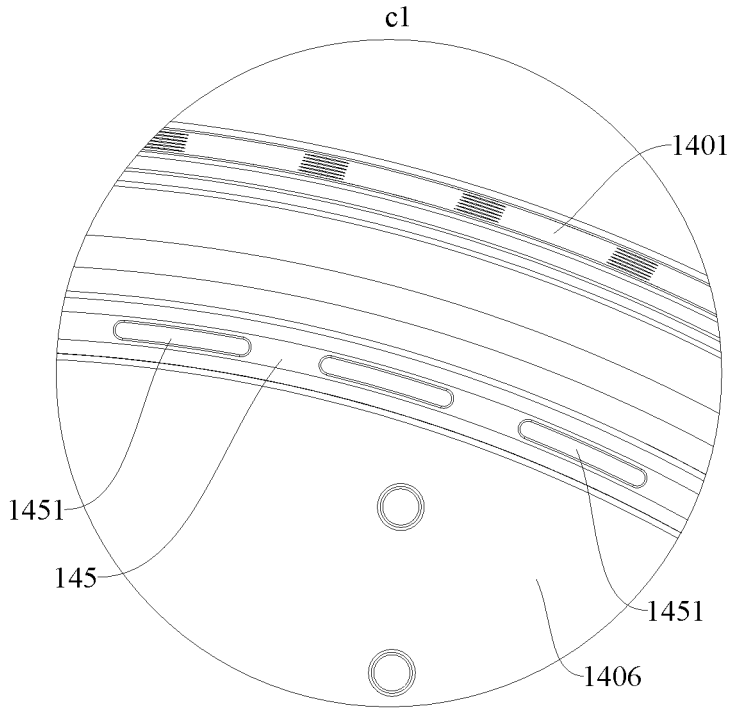
FIG. 18 is an enlarged view of part c1 shown in FIG. 17.

As shown in FIGS. 14 and 15 as well as FIGS. 17 and 18, in some examples, the third recess 145 has third material feeding ports 1451 defined thereon and arranged at intervals in an extending direction of the third recess. In the injection molding process, the sizing material for forming the outer tub 12 enters the third recess 145 through material feeding ports 1451 to tightly connect a part of the outer tub 12 and the third recess 145, to ensure the connection reliability between the outer tub 12 and the lining tub 14.

For example, the third material feeding ports 1451 may be circular holes arranged at intervals in a circumferential direction of the third recess 145, as shown in FIG. 15. For example, the third material feeding ports 1451 may be elliptical waist-shaped holes arranged at intervals in the circumferential direction of the third recess 145, as shown in FIG. 18. For example, some of third material feeding ports 1451 may be the circular holes, and the remaining third material feeding ports 1451 may be the elliptical waist-shaped holes. Of course, the third material feeding port 1451 may also have other shapes, which may be adjusted as desired.

As shown in FIGS. 7 to 22, a tub assembly 1 according to further embodiments of the present disclosure includes an outer tub 12 and a lining tub 14 disposed in the outer tub 12 and fixedly connected to the outer tub 12. At least a part of the lining tub 14 is recessed away from the inside of the lining tub 14 to form at least one recess (such as a first recess 142 and a second recess 143 described below). The at least one recess has at least one material feeding port defined thereon (such as a first material feeding port 1421 defined on the first recess 142 and a second material feeding port 1431 defined on the second recess 143, as described later).

In the tub assembly 1 according to the embodiment of the present disclosure, by forming the at least one material feeding port on the at least one recess, in an injection molding process, a sizing material for forming the outer tub 12 enters the recess through the at least one material feeding port to tightly connect a part of the outer tub 12 and the at least one recess, thereby further ensuring a connection reliability between the outer tub 12 and the lining tub 14.

In some embodiments, the recess is located on a bottom 1406 and/or a tub body 1401 of the lining tub 14.

In some embodiments, the at least one material feeding port includes one material feeding port located in a middle of a wall of the at least one recess.

In some embodiments, as shown in FIG. 9, in this embodiment, the at least one recess includes a first recess 142 defined on the bottom 1406 of the lining tub 14, and the first recess 142 has a first material feeding port 1421 defined thereon. As shown in FIG. 12, in this embodiment, the at least one recess includes a second recess 143 defined on the tub body 1401 of the lining tub 14, and the second recess 143 has a second material feeding port 1431 defined thereon. As shown in FIG. 15 and FIG. 18, in this embodiment, the at least one recess includes a third recess 145 defined on the bottom 1406 of the lining tub 14, and the third recess 145 has a third material feeding port 1451 defined thereon.

In some other embodiments, the at least one recess also has openings 1432 arranged at intervals in circumference of the material feeding port. In the injection molding process, the sizing material for forming the outer tub 12 enters the recess through the material feeding port and openings 1432, respectively, to tightly connect a part of the outer tub 12 and the at least one recess, thereby further ensuring the connection reliability between the outer tub 12 and the lining tub 14.

Figure 19:
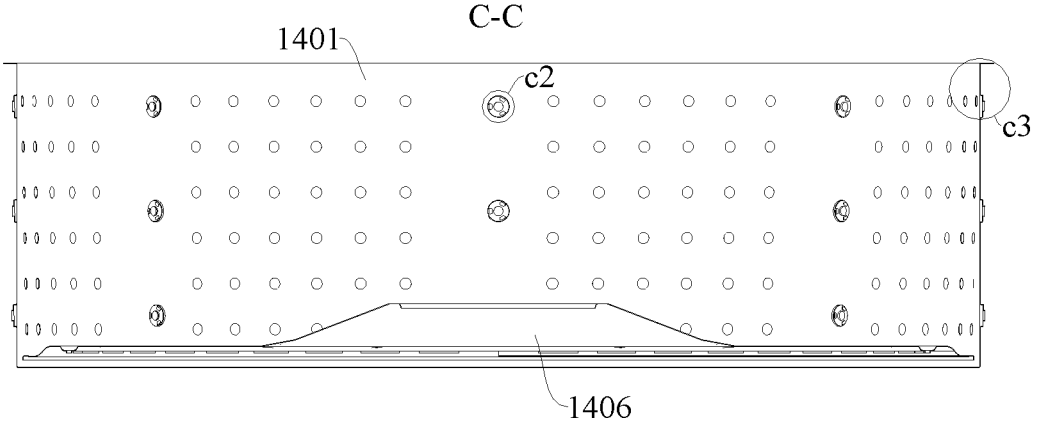
FIG. 19 is a cross-sectional view taking along line C-C in FIG. 17.
Figure 20:
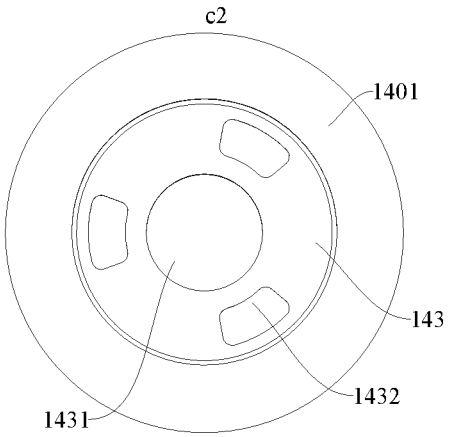
FIG. 20 is an enlarged view of part c2 shown in FIG. 19.
Figure 21:
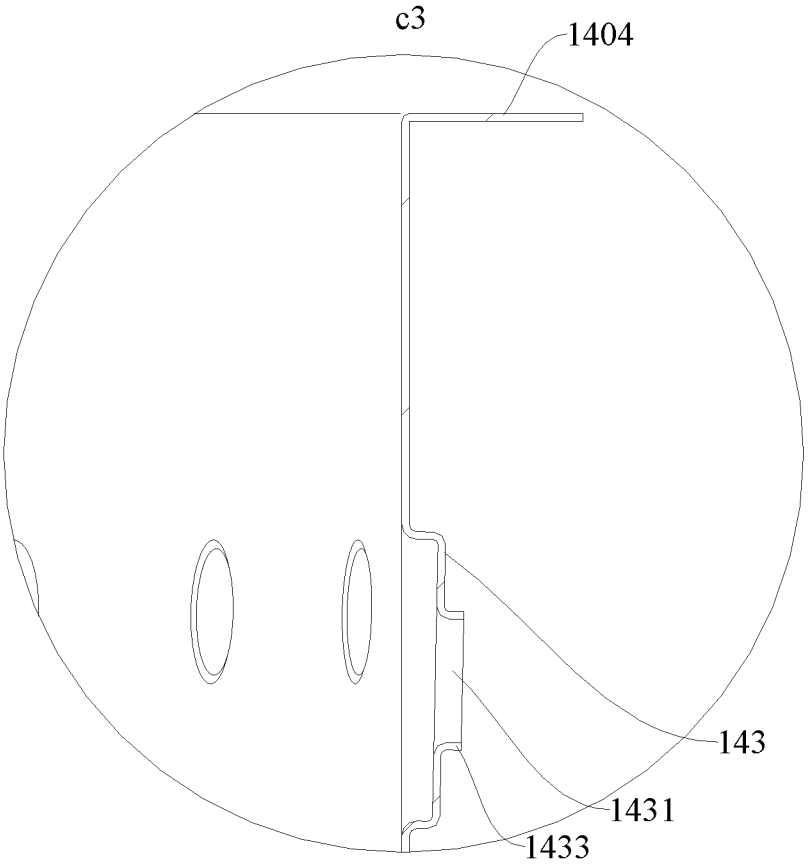
FIG. 21 is an enlarged view of part c3 shown in FIG. 19.
Figure 22:
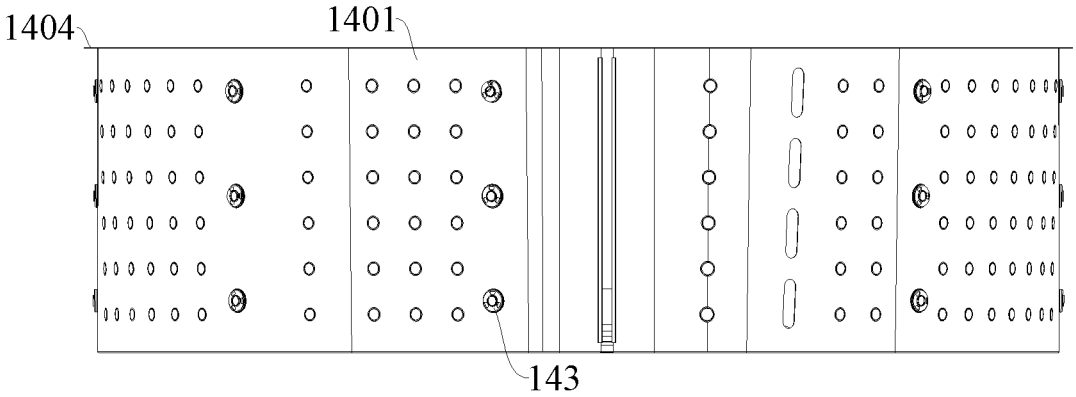
FIG. 22 is a side view of the lining tub of the tub assembly shown in FIG. 19.
Figure 23:
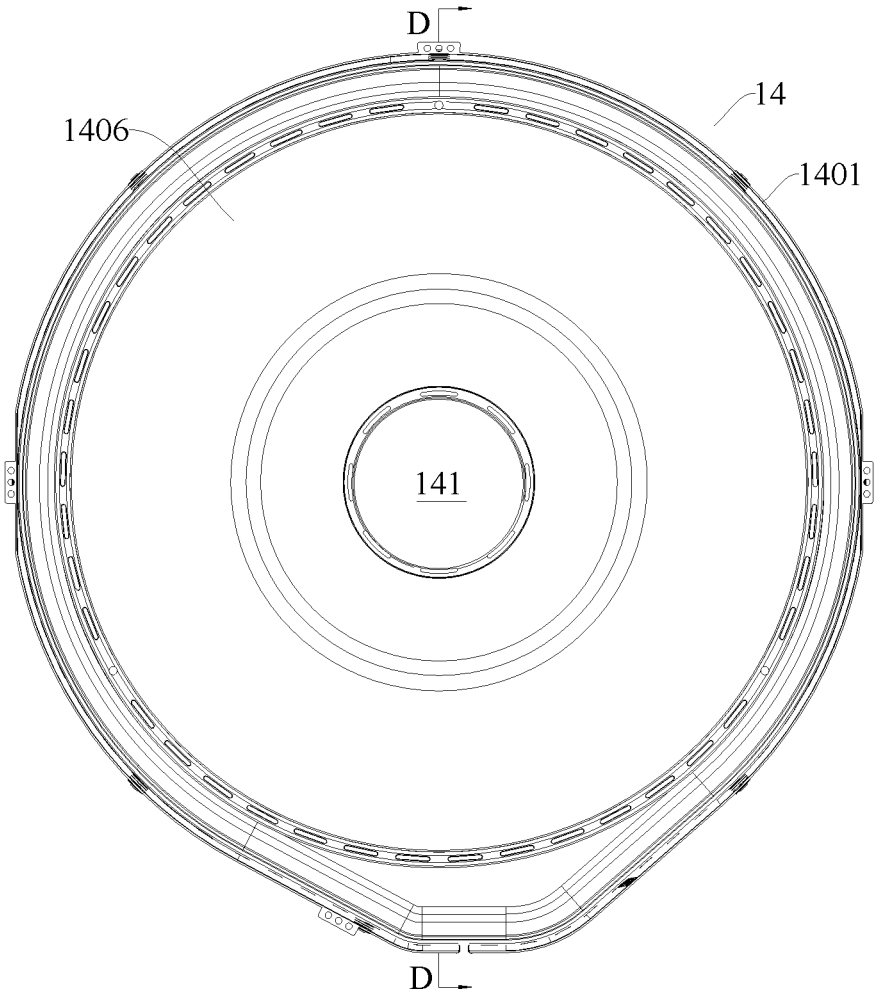
FIG. 23 is a front view of a lining tub of a tub assembly according to another example of the present disclosure.

In some embodiments, as shown in FIGS. 19 to 21, in this embodiment, the at least one recess includes a second recess 143 defined on the tub body 1401 of the lining tub 14, and the second recess 143 has a second material feeding port 1431 and openings 1432 defined thereon. The second material feeding port 1431 is located in a middle of the second recess 143, and openings 1432 is arranged at intervals in a circumference of the second material feeding port 1431.

In some examples, the openings 1432 are located on a bottom wall and/or a side wall of the at least one recess. For example, the openings 1432 may be formed on a side wall of the at least one recess. In the injection molding process, the sizing material for forming the outer tub 12 can enter the recess through the material feeding port and the openings 1432 from different directions to tightly connect the part of the outer tub 12 and the recess. Further, it is also possible to ensure the connection reliability between the outer tub 12 and the lining tub 14, and to improve a deformation resistance of the recess under a thermal shock.

In some examples, the opening 1432 is at least one of a circular hole or an elliptical waist-shaped hole. For example, the opening 1432 may be the circular hole, and circular holes is arranged at intervals in the circumferential direction of the material feeding port on the recess. For example, the opening 1432 may be the elliptical waist-shaped hole, and elliptical waist-shaped holes is arranged at intervals in the circumferential direction of the material feeding port on the recess. Of course, some of openings 1432 may be the circular holes, and the remaining openings may be the elliptical waist-shaped holes. Of course, the opening 1432 may also have other shapes, which may be adjusted as desired.

In some embodiments, a rim of the material feeding port has a folded edge 1433 extending in a direction away from the interior of the lining tub 14. The folded edge 1433 is embedded in the outer tub 12, thereby further enhancing a binding capacity between the outer tub 12 and the lining tub 14.

In some embodiments, the at least one recess includes a first recess 142 defined on the bottom 1406 of the lining tub 14, and the first recess 142 has a first material feeding port 1421 defined thereon. A rim of the first material feeding port 1421 has a folded edge 1433 extending in a direction away from the interior of the lining tub 14. As shown in FIG. 20 and FIG. 21, the at least one recess includes a second recess 143 defined on the tub body 1401 of the lining tub 14, and the second recess 143 has a second material feeding port 1431 defined thereon. A rim of the second material feeding port 1431 has a folded edge 1433 extending in a direction away from the interior of the lining tub 14.

As shown in FIG. 23 to FIG. 28, in some embodiments, an end of the tub body 1401 of the lining tub 14 close to the bottom thereof has a first flange 1402 extending in a direction facing towards or away from a center of the bottom 1406 of the lining tub 14 and embedded in the bottom of the outer tub 12. By providing the first flanging 1402 and embedding the first flanging 1402 in the bottom of the outer tub 12, the bonding capability between the tub body 1401 of the lining tub 14 and the bottom of the outer tub 12 can be increased by means of the first flanging 1402, thereby ensuring a bonding tightness between the tub body 1401 of the lining tub 14 and the bottom of the outer tub 12 under the thermal shock.

Figure 27:
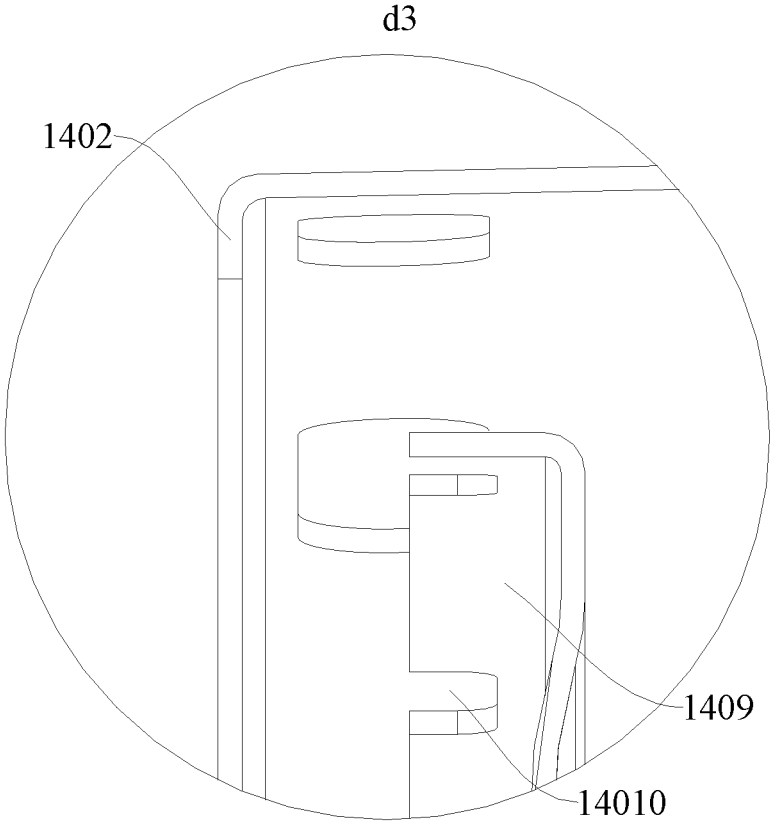
FIG. 27 is an enlarged view of part d3 shown in FIG. 24.
Figure 28:
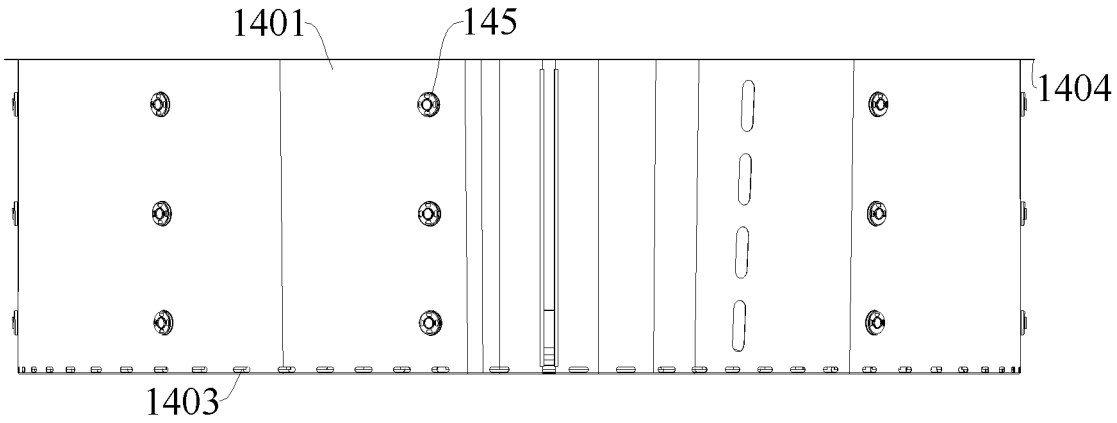
FIG. 28 is a side view of the lining tub of the tub assembly shown in FIG. 23.

As shown in FIG. 27 and FIG. 28, in some embodiments, second through holes 1403 is defined at a position on the tub body 1401 of the lining tub 14 close to the first flanging and arranged at intervals in a circumferential direction of the tub body 1401 of the lining tub 14.

Therefore, by providing second through holes 1403, a molten plastic material thus can flow more smoothly, thereby ensuring that the tub body 1401 of the lining tub 14 would not be deformed by an impact of the high-pressure plastic material. Further, it is possible to increase the bonding capability between the tub body 1401 of the lining tub 14 and the bottom of the outer tub 12, thereby further ensuring the bonding tightness between the tub body 1401 of the lining tub 14 and the bottom of the outer tub 12 under the thermal shock.

Figure 24:
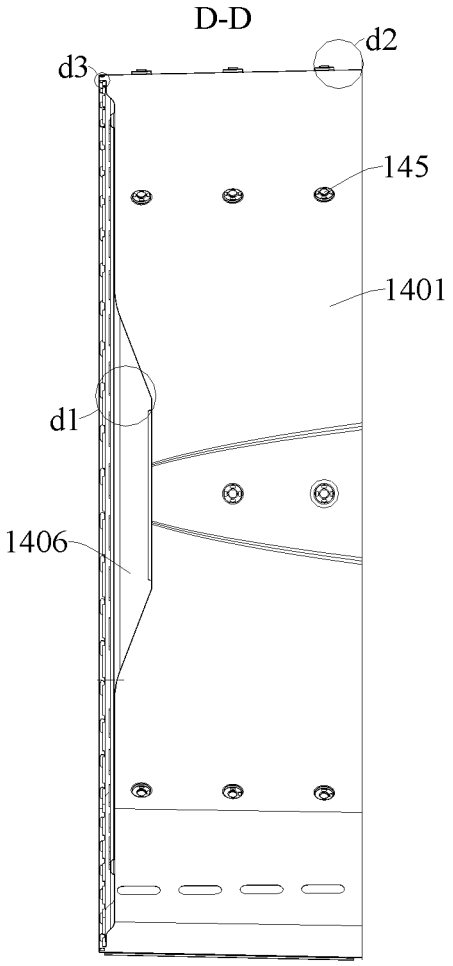
FIG. 24 is a sectional view taking along line D-D in FIG. 23.
Figure 26:
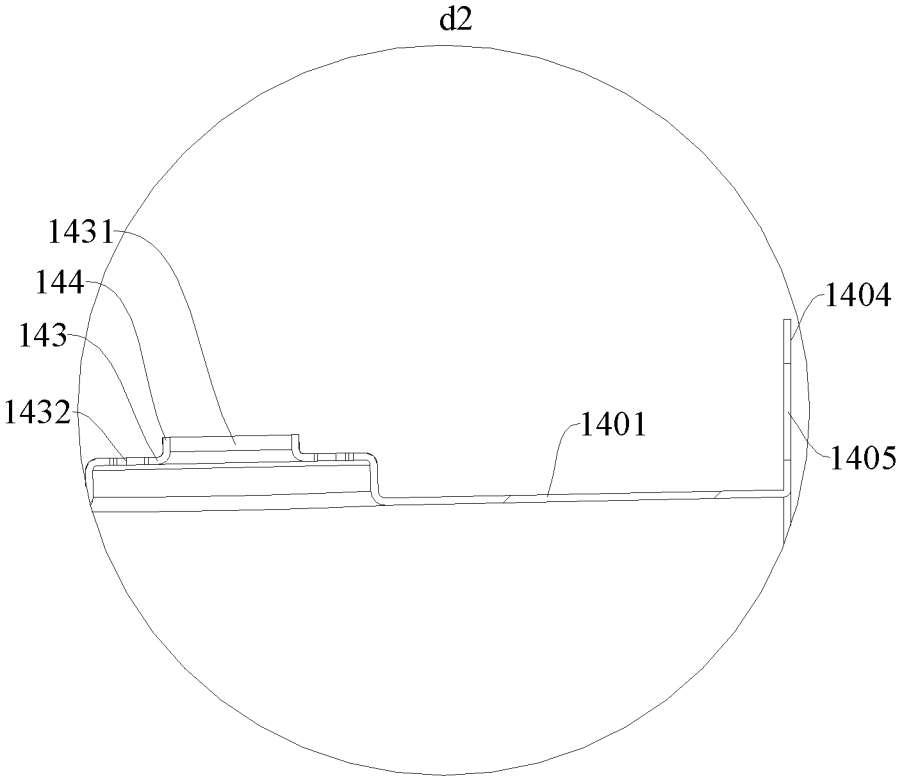
FIG. 26 is an enlarged view of part d2 shown in FIG. 24.

As shown in FIGS. 24 and 26, in some embodiments, an end of the tub body 1401 of the lining tub 14 away from the bottom thereof has a second flanging 1404 extending in a direction facing away from the center of the tub body 1401 of the lining tub 14 and embedded in tub body of the outer tub 12. By providing the second flanging 1404 and embedding the second flanging 1404 in tub body of the outer tub 12, the bonding capability between the tub body 1401 of the lining tub 14 and tub body of the outer tub 12 can be increased by means of the second flanging 1404, thereby ensuring the bonding tightness between the tub body 1401 of the lining tub 14 and tub body of the outer tub 12 under the thermal shock.

In some examples, the second flanging 1404 may be form into a closed ring extending in a circumferential direction of the tub body 1401 of the lining tub 14, or may be formed into an open ring extending in the circumferential direction of the tub body 1401 of the lining tub 14. The second flanging 1404 has third through holes 1405 defined thereon, and third through holes 1405 is arranged at intervals in a direction of the second flanging 1404 extending in the circumferential direction of the tub body 1401 of the lining tub 14. Therefore, by forming third through holes 1405 on the second flanging 1404, the molten plastic material can flow more smoothly, thereby ensuring that the tub body 1401 of the lining tub 14 would not be deformed by the impact of the high-pressure plastic material. Further, it is also possible to increase the bonding capability between the tub body 1401 of the lining tub 14 and the bottom of the outer tub 12, thereby further ensuring the bonding tightness between the tub body 1401 of the lining tub 14 and the bottom of the outer tub 12 under the thermal shock.

Figure 25:
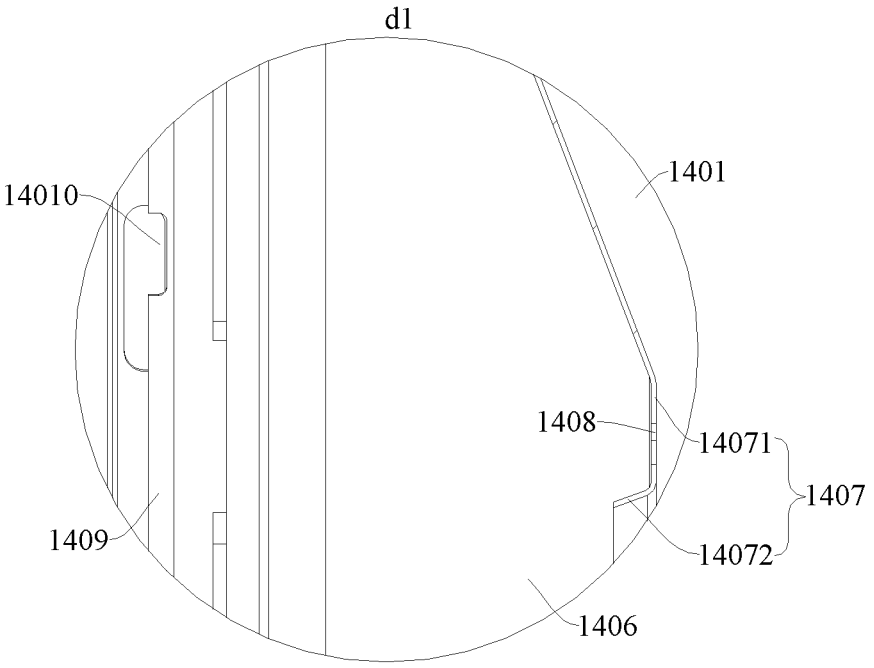
FIG. 25 is an enlarged view of part d1 shown in FIG. 24.

As shown in FIG. 24 and FIG. 25, in some embodiments, a through opening 141 is defined on a middle portion of the bottom 1406 of the lining tub 14, and a rim of the through opening 141 has a third flanging 1407 extending in a circumferential direction thereof and embedded in the bottom of the outer tub 12. By providing the third flanging 1407 and embedding the third flanging 1407 in the bottom of the outer tub 12, the bonding ability between the bottom 1406 of the lining tub 14 and the bottom of the outer tub 12 can be increased by means of the third flanging 1407, thereby ensuring the bonding tightness between the bottom 1406 of the lining tub 14 and the bottom of the outer tub 12 under the thermal shock.

As shown in FIG. 25, in some embodiments, the third flanging 1407 includes a straight section 14071 and an inclined section 14072 that are arranged in sequence from outside to inside in a radial direction of the bottom 1406 of the lining tub 14. The straight section 14071 extends in the radial direction of the bottom 1406 of the lining tub 14, and the inclined section 14072 gradually extends obliquely in a direction facing away from the tub opening of the outer tub 12 from outside to inside.

In some embodiments, as shown in FIG. 9, an inner surface of the bottom of the outer tub 12 has a supporting boss 122, and the bottom 1406 of the lining tub 14 matches with the supporting boss 122 in contour and is closely attached with the supporting boss 122. The supporting boss 122 has an installation port 123 corresponding to a position of the through opening 141, and the third flanging 1407 is embedded in a peripheral wall of the supporting boss 122. Due to higher structural strength of the supporting boss 122, by embedding the third flanging 1407 in the peripheral wall of the supporting boss 122, the connection reliability between the bottom 1406 of the lining tub 14 and the bottom of the outer tub 12 can be further improved.

As shown in FIG. 25, in some embodiments, the third flanging 1407 has first through holes 1408 defined thereon, and first through holes 1408 is arranged at intervals in a direction of the third flanging 1407 extending in a circumferential direction of the through opening 141.

For example, the first through hole 1408 may be a circular hole, and circular holes is arranged at intervals in the direction of the third flanging 1407 extending in the circumferential direction of the through opening 141. For example, the first through hole 1408 may be an elliptical waist-shaped hole, and elliptical waist-shaped holes is arranged at intervals in the direction of the third flanging 1407 extending in the circumferential direction of the through opening 141.

Therefore, by forming first through holes 1408 on the third flanging 1407, the molten plastic material can flow more smoothly, thereby ensuring the bottom 1406 of the lining tub 14 would not be deformed by the impact of the high-pressure plastic material. Further, it is also possible to increase the bonding capability between the bottom 1406 of the lining tub 14 and the bottom of the outer tub 12, thereby further ensuring the bonding tightness between the bottom 1406 of the lining tub 14 and the bottom of the outer tub 12 under the thermal shock.

As shown in FIGS. 24 and 25, in some embodiments, an outer periphery of the bottom 1406 of the lining tub 14 has a fourth flanging 1409 extending in a direction facing away from the tub opening of the outer tub 12 and embedded in the bottom of the outer tub 12. By providing the fourth flanging 1409 and embedding the fourth flanging 1409 in the bottom of the outer tub 12, the bonding capability between the bottom 1406 of the lining tub 14 and the bottom of the outer tub 12 can be increased by means of the fourth flanging 1409, thereby ensuring the bonding tightness between the bottom 1406 of the lining tub 14 and the bottom of the outer tub 12 under thermal shock.

As shown in FIG. 25, in some embodiments, the fourth flanging 1409 may be form into a closed ring extending in the circumferential direction of the bottom 1406 of the lining tub 14, or may be formed into an open ring extending in the circumferential direction of the bottom 1406 of the lining tub 14. The fourth flange 1409 has first notches 14010 arranged at intervals in a direction of the fourth flange 1409 extending in the circumferential direction of the bottom 1406 of the lining tub 14, and each of first notches 14010 is open away from the tub opening of the outer tub 12.

Therefore, by providing first notches 14010 on the fourth flanging 1409, the molten plastic material can flow more smoothly, thereby ensuring that the bottom 1406 of the lining tub 14 would not be deformed by the impact of the high-pressure plastic material. Further, it is also possible to increase the bonding capability between the bottom 1406 of the lining tub 14 and the bottom of the outer tub 12, thereby further ensuring the bonding tightness between the bottom 1406 of the lining tub 14 and the bottom of the outer tub 12 under the thermal shock.

Figure 10:
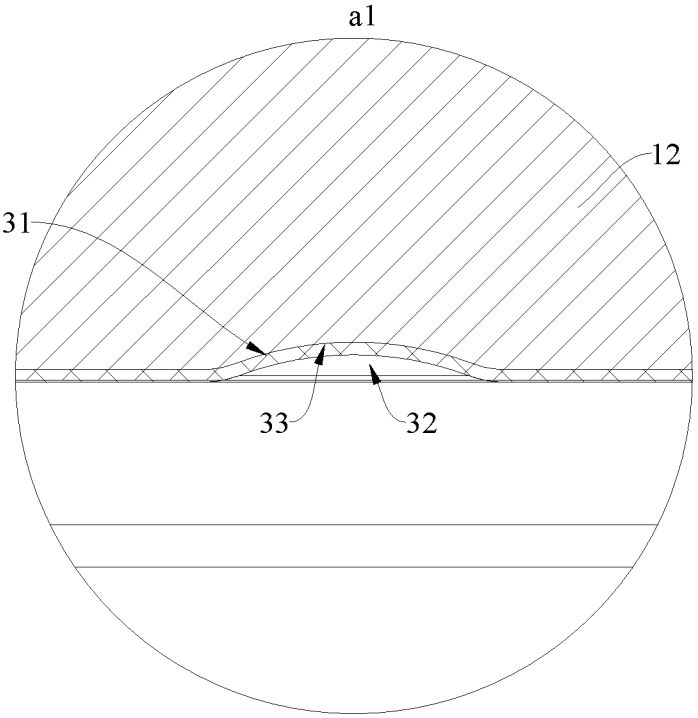
FIG. 10 is an enlarged view of part a1 shown in FIG. 9.

In some embodiments, as shown in FIGS. 8 and 10, the at least one recess includes a groove 32, and a part of a wall of the lining tub 14 is recessed towards outside of the lining tub to form the groove 32 on an inner wall surface of the lining tub 14 and to form a convex portion 31 on an outer wall surface of the lining tub 14. The convex portion 31 on the outer surface of the lining tub 14 may be formed by a stamping process, and thus the processing is simple and easy to be realized. Correspondingly, the outer tub 12 is formed with a concave portion 33 cooperated with the convex portion 31 during molding the outer tub 12 to improve the bonding capability between the outer tub 12 and the lining tub 14.

Here, each of the convex portion 31 and the concave portion 33 has a continuous and smooth curved surface. That is, the convex portion 31 has a surface in close contact with the surface of the concave portion 33 to ensure the connection reliability between the outer tub 12 and the lining tub 14. For example, the convex portion 31 may be formed into a part of a convex spherical surface, and the concave portion 33 may be formed into a part of a concave spherical surface. Of course, each of the convex portion 31 and the concave portion 33 may have other shapes.

A washer according to embodiments of the present disclosure includes the tub assembly 1 according to the embodiments as described above. The washing machine herein may be a front load washer, a top load washer with a wave-impeller, or a washer with drying function.

Since the tub assembly 1 according to the embodiments of the present disclosure has the above-mentioned effect, the washer according to the embodiments of the present disclosure also has the above-mentioned effect. That is, the washing effect of the laundry treatment device of the present application is better, and problems such as health and hygiene can be avoided. In addition, since the tub assembly 1 has good structural strength and strong deformation resistance, it is beneficial to prolong the service life of the laundry treatment device.

Other structures and operations of the washer according to the embodiments of the present disclosure are known, and will not be described in detail here.

In the description of this specification, reference to the terms "one embodiment," "some embodiments," "exemplary embodiment," "example," "specific example," or "some examples", etc., is intended to means that a particular feature, structure, material, or characteristic described by an example or example combined with the embodiment is included in at least one embodiment or example of the present disclosure. In this specification, schematic representations of the above terms do not necessarily refer to the same embodiment or example. Furthermore, the described particular features, structures, materials or characteristics may be combined in any suitable manner in any one or more embodiments or examples.

What is claimed is:

1. A tub assembly, comprising:

an outer tub; and a lining tub disposed in the outer tub and fixedly connected to the outer tub;

wherein the outer tub and the lining tub are formed into an integral structure through an injection molding process;

wherein at least a part of the lining tub is recessed away from inside of the lining tub to form at least two recesses, each of the at least two recesses having a material feeding port defined thereon.

2. The tub assembly according to claim 1, further comprising:

an adhesive disposed between the outer tub and the lining tub to bond the lining tub on an inner wall of the outer tub.

3. The tub assembly according to claim 1, wherein the lining tub has a through opening defined on a bottom thereof, a rim of the through opening being embedded in a bottom of the outer tub.

4. The tub assembly according to claim 1, wherein one of the at least two recesses have a recessed depth smaller than a thickness of the lining tub, and/or one of the at least two recesses have a recessed depth greater than or equal to the thickness of the lining tub.

5. The tub assembly according to claim 1, wherein the at least two recesses comprises a first recess located on a bottom of the lining tub.

6. The tub assembly according to claim 1, wherein the at least two recesses comprises a second recess located on a tub body of the lining tub.

7. The tub assembly according to claim 6, having a second material feeding port defined on the second recess close to a bottom of the outer tub.

8. The tub assembly according to claim 1, wherein at least a part of a rim of the lining tub protrudes towards outside of the lining tub to form a bent portion, the bent portion being embedded in a rim of the outer tub.

9. The tub assembly according to claim 1, wherein a tub body and a bottom of the lining tub are integrally formed in such a manner that the lining tub is formed as an integral structure.

10. The tub assembly according to claim 1, wherein a tub body and a bottom of the lining tub are separately formed in such a manner that the lining tub is formed as a separated structure.

11. A washing machine, comprising the tub assembly according to claim 1.

* * * * *